US005090841A

United States Patent [19]

Penick, Jr. et al.

[11] Patent Number: 5,090,841

[45] Date of Patent: Feb. 25, 1992

[54] BOAT LIFT

[75] Inventors: Clarence A. Penick, Jr., Hudson; Darrel Walters, Angola, both of Ind.

[73] Assignee: Brammall, Inc., Angola, Ind.

[21] Appl. No.: 578,141

[22] Filed: Sep. 6, 1990

[51] Int. Cl.[5] ..... B63C 3/06

[52] U.S. Cl. ..... 405/3; 114/45; 405/1

[58] Field of Search ..... 405/1, 3; 114/45–48; 414/678

[56] References Cited

U.S. PATENT DOCUMENTS 3,021,965 2/1962 Harvey ..... 414/678
3,077,742 2/1963 Brown ..... 405/3
3,265,024 8/1966 Kramlick ..... 114/45
3,275,167 9/1966 Godbersen .
3,284,052 11/1966 Godbersen .
4,027,492 6/1977 Carpenter ..... 405/3
4,900,187 2/1990 Uchida et al. ..... 405/3
4,954,011 9/1990 Stenson ..... 114/48

*Primary Examiner*—Dennis L. Taylor
*Attorney, Agent, or Firm*—Hill, Van Santen, Steadman & Simpson

[57] ABSTRACT

A boat lift in which a hydraulic pump and cylinder with a piston is mounted on a manual boat lift so that the piston rod carries a pulley which engages the lifting cable so that when the piston moves in the cylinder the boat will move up or down.

2 Claims, 2 Drawing Sheets

BOAT LIFT

BACKGROUND OF THE INVENTION

1. Field of the Invention

This invention relates in general to boat lifts and in particular to a boat lift.

2. Description of Related Art

Boat lifts are known in which a wheel connected to a capstan is utilized to move cables so as to raise and lower a boat resting on a platform so as to place it into and out of the water. See, for example, U.S. Pat. No. 3,284,052 and 3,275,167.

SUMMARY OF THE INVENTION

It is a feature of the present invention to provide a boat lift apparatus in which a piston with a hydraulic driving means is attached to the boat lifting mechanism so as to allow the boat to be raised and lowered relative to the water.

It is a feature of the present invention that a piston rod which carries a roller engages the lifting cable and draws it between two stationary rollers so as to cause the boat carrying platform or cradle to be selectively moved vertically relative to the water so as to lift the boat out of or lower it and into the water.

The present invention can be easily and simply installed to a conventional wheel operated boat lift.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
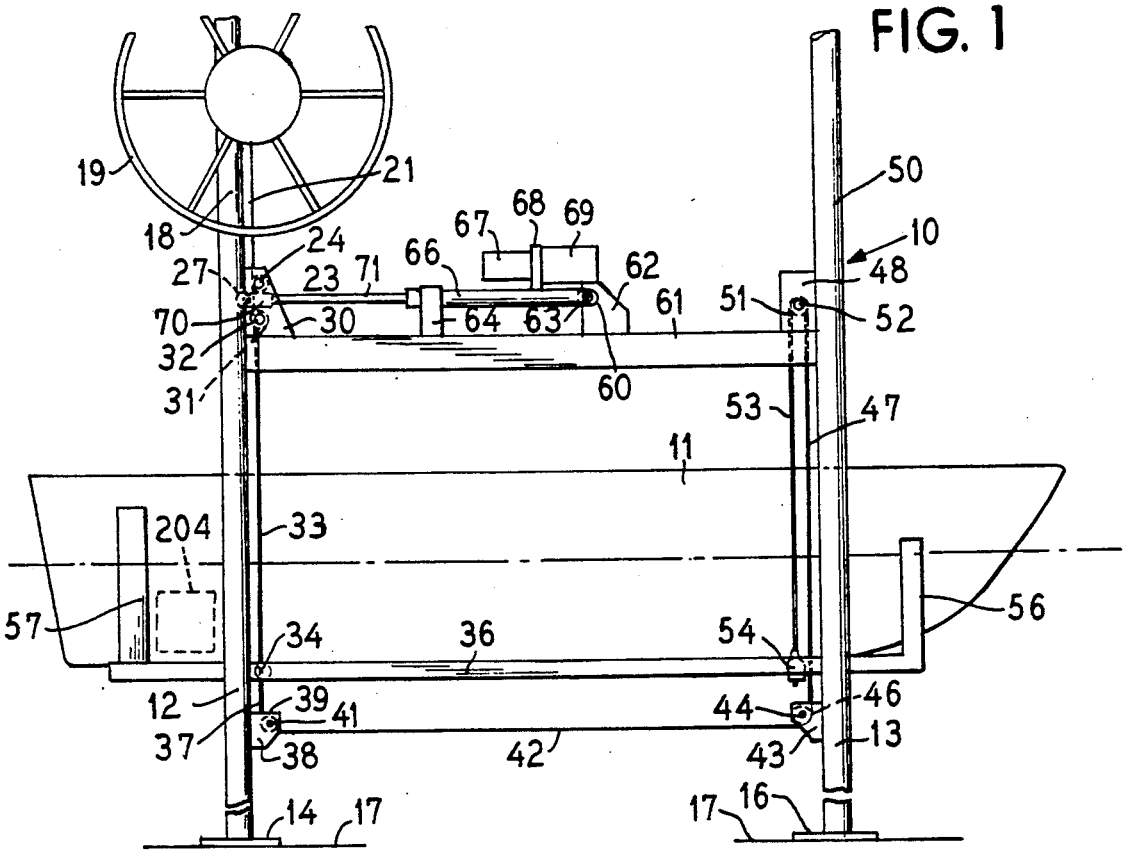
FIG. 1 is a side plan view illustrating the boat on the lift with the boat in the down position.

The FIGS. illustrate a boat lift 10 for lifting a boat 11 from the water. The boat 11 can be moved onto the carriage 36 by moving it to the right relative to FIG. 1 when the carriage 36 is in the lowered position such that the front portion of the carriage 36 engages the bow of the boat and front and rear bumpers 56 and 57 engage the sidewalls of the boat. Four upright members 12 and 13 and two associate upright members on the other side of the boat rest on feet 14 and 16 against the bottom of the lake or other body of water. A conventional manual raising mechanism comprising a wheel 19 rotatably attached to the upper ends 18 of the two rear uprights 12 has a capstan mounted on its support shaft to which a cable 21 is attached which passes from the capstan on the wheel 19. The cable 21 has a lower portion 33 of the cable is connected by a fastener 34 to the boat carriage 36. Below the fastener 34, the cable is designated by 37 and passes around a pulley 39 rotatably supported by a shaft 41 to a bracket 38 which is attached to the lower portion of the upright 12. The cable portion 42 then extends from pulley 39 to a pulley 46 mounted on a shaft 44 connected to a bracket 43 connected to the upright 13 adjacent the front portion of the boat. The cable portion 47 passes from the pulley 44 over a pulley 51 mounted on a shaft 52 connected to a bracket 48 connected to an upper portion of the upright 13 and a cable portion 53 passes down from pulley 51 to a fastener 54 which is connected to the carriage 36.

When the wheel 19 is manually rotated, it winds the portion 21 of the cable around the capstan on the support shaft of the wheel 19 so as to move the carriage 36 upwardly relative to FIG. 1. Such mechanism is conventional and can be used to raise and lower the boat by rotating the wheel 19. The present invention provides for raising and lowering the boat without turning the wheel 21. It is to be realized that generally a ratchet holds the wheel 19 in a locked position so that when the boat is raised, the wheel will not allow the boat to be lowered unless the ratchet is released so that the boat does not accidentally lower into the water.

Figure 3:
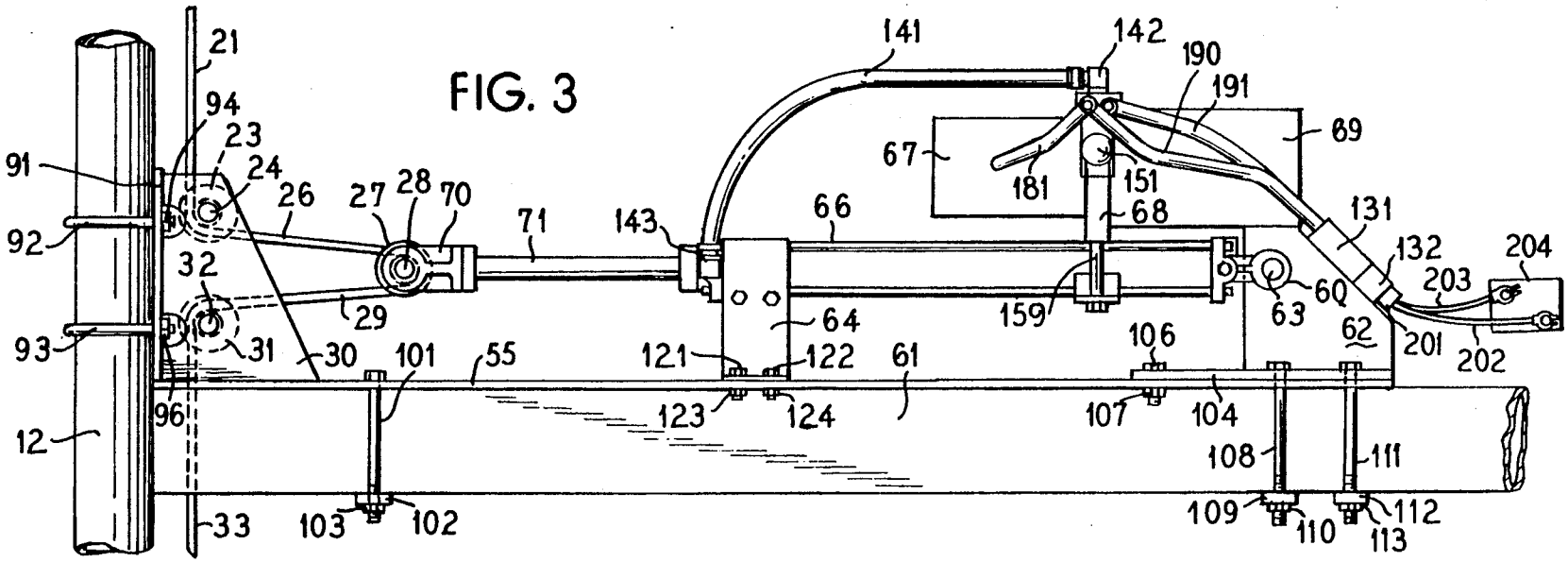
FIG. 3 is an enlarged side plan view of the boat lifting mechanism of the invention.

The present invention utilizes a cross-member 61 between the upper portion 18 of upright 12 and the upper portion 50 of upright 13. FIG. 3 illustrates in detail how the crossmember 61 is attached to the upright 12 at one end thereof. The upper plate 55 is connected by bolts 101, washer 102 and screws 103 to the cross-member 61. A plate 91 on bracket 30 extends upwardly from the member 55 and 61 and is connected by U-bolts 92 and 93 and nuts 94 and 96 to the upright 12 as shown in FIG. 3. The bracket 30 is thus attached by the U-bolts 92 and 93 to the upright 12. A pair of pulleys 23 and 31 are rotatably supported from bracket 30 by shafts 24 and 32 and the upper cable portion 21 passes around pulley 23 and has a portion 26 which passes around a pulley 27 rotatably supported by a shaft 28 on a bracket 70 which is connected to a piston rod 71 of a piston mounted in a hydraulic cylinder 66. Cable portion 29 passes from pulley 27 around the pulley 31 and the cable portion 33 extends between the pulley 31 and a fastener 34 which connects the cable to the carriage 36. Portion 37 of the cable passes from fastener 34 around pulley 39 as shown.

The cylinder 66 is connected by brackets 62 and 64 to the plate 55 by bolts 108 and 111 which carry washers 109, 112 and nuts 110 and 113 and bolts 121 and 122 which receive nuts 123 and 124 as shown in FIG. 3, for example. The rear end of the cylinder 66 is connected by U-shaped bracket 60 and a shaft 63 to the bracket 62. The hydraulic power pump 69 which may be a Dayton pump type 4Z185 has a hydraulic control 68 and a motor 67 is mounted to the bracket 62 and is connected to the cylinder 66 by a fastener 159. An operating handle 151 is connected to the hydraulic power pump 69. A battery cable 191 is connected to a suitable connector 131 which mates with connector 201 that has cables 201 and 203 which are connected to battery 204 in the boat. Electric power is supplied to the electric motor 67 within the hydraulic power pump. The A control handle 151 actuates the hydraulic power pump by starting the electric motor 67 to drive the pump to supply hydraulic fluid through the connector 142 from the pump through a hydraulic line 141 and connector 143 to the cylinder 66 to move the piston which is connected to the piston rod 71 so as to move the pulley 27 and the cable portions 26 and 29 to the right relative to the FIGS. When handle 151 is up the motor 67 and pump 69 run to lift the boat. When the handle 151 is down the fluid in the cylinder is released and the weight of the boat causes the boat to be lowered.

Figure 2:
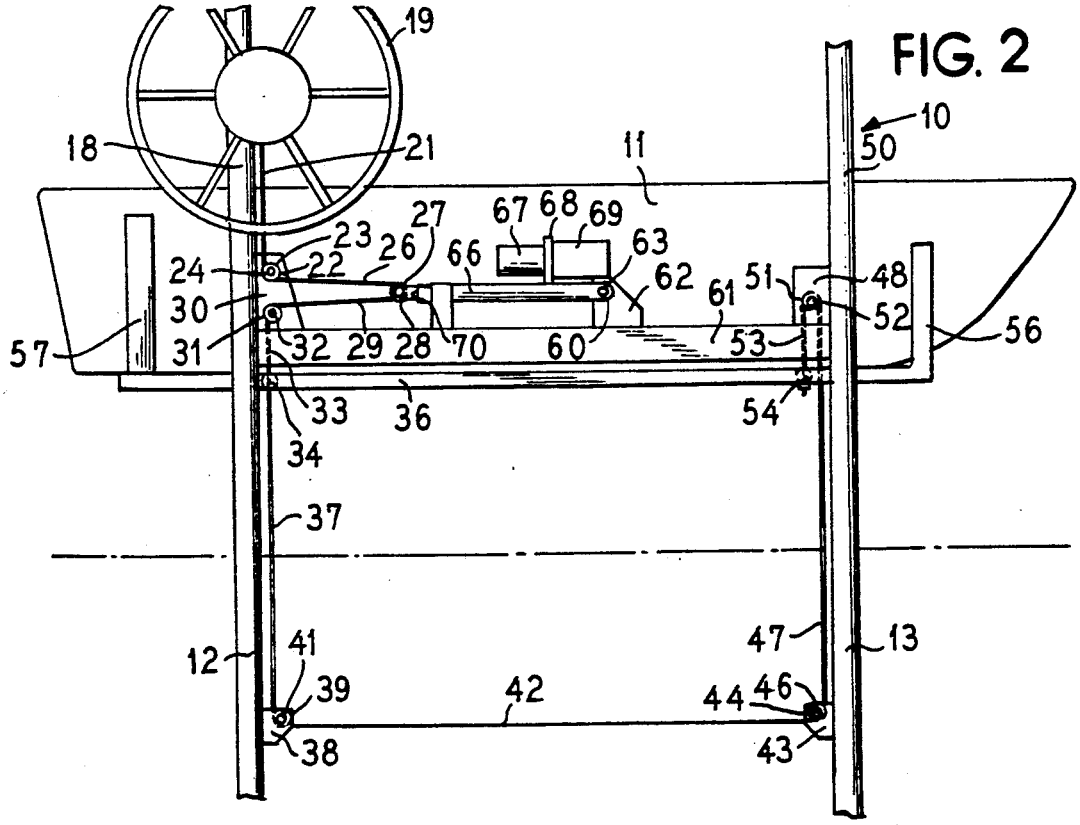
FIG. 2 is a side plan view of the invention illustrating the boat in the raised position.
Figure 4:
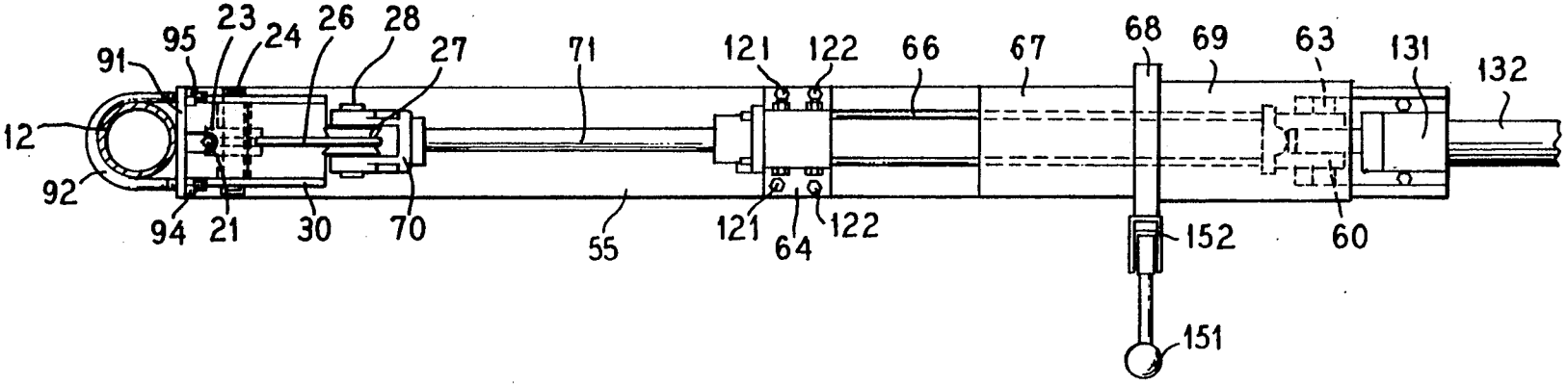
FIG. 4 is a top plan view of the boat lifting mechanism.

In operation, when the carriage 36 is in the lowered position as shown in FIG. 1, the carriage 36 can be moved manually by rotating the wheel 19 in a conventional manner so as to raise and lower it. In this condition, the piston rod 71 is in the far left position relative to FIG. 1 so that the pulley 27 does not shorten the cable 21 and manual operation can occur. When the carriage 36 is in any position, the carriage may be raised and lowered by moving the control handle 151 which starts the pump motor 67 in the hydraulic power pump unit 69 to supply hydraulic fluid through the line 141 to the cylinder 66 to move the piston to the right thus moving the piston shaft to the right relative to the FIGS. to move the brackets 70 and pulley 27 to the right thus raising the carriage 36 as the cable portions 26 and 29 are lengthened by the hydraulic cylinder 66. Thus, as the piston rod 71 moves to the right relative to FIG. 1, it will move until it has a position such as shown in FIG. 2 where the carriage 36 has been moved from the full down position to the full up position so as to raise the boat 11 from the water. When it is desired to lower the boat, the control handle 51 is moved to the down position which causes the hydraulic fluid to be released and the weight of the boat to lower the carriage 36.

A protective cover can be placed over the hydraulic power pump 69 and the cable portions 22 and 29 if desired.

It is seen that this invention provides an automatic boat lift and although the invention has been described with respect to preferred embodiments, it is not to be so limited as changes and modifications can be made which are within the full intended scope of the invention as defined by the appended claims.

We claim as my invention:

1. A boat lift which can selectively be operated manually or by power comprising a frame with first and second end portions, a manual wheel and capstan rotatably mounted on said frame, a boat carriage with first and second end portions mounted between said frame, a cable with one end attached to the first end portion of said boat carriage, a first pulley rotatably attached to an upper portion of said first end portion of said frame and said cable passing thereover, a second pulley rotatably attached to a lower portion of said first end portion of said frame and said cable passing from said first pulley through said second pulley, a third pulley rotatably attached to a lower portion of said second end portion of said frame and said cable passing from said second pulley through said third pulley, a fourth pulley rotatably attached to an upper portion of said second end portion of said frame and said cable extending from said third pulley to said fourth pulley and attached to the second end portion of aid boat carriage between said third and fourth pulleys, a fifth pulley rotatably attached to said upper portion of said second end portion of said frame above said fourth pulley and said cable extending between said fourth and fifth pulleys, said cable extending from said fifth pulley to said capstan and attached thereto, a hydraulic cylinder with a moveable piston and piston rod attached to said frame, a sixth pulley attached to the free end of said piston rod and said cable between said fourth and fifth pulleys passing over said sixth pulley such that when said hydraulic cylinder is actuated to move said piston rod said boat carriage can be moved up and down relative to said frame.

2. A boat lift according to claim 1 including a hydraulic pump connected to said hydraulic cylinder, and a driving means connected to said hydraulic pump.

* * * * *